US005118318A

United States Patent [19]

Lorizio

[11] Patent Number: 5,118,318

[45] Date of Patent: Jun. 2, 1992

[54] SECURITY OBJECT SYSTEM

[76] Inventor: Robert J. Lorizio, 11 Selwyn Rd., Braintree, Mass. 02184

[21] Appl. No.: 655,842

[22] Filed: Feb. 14, 1991

[51] Int. Cl.[5] ..... A63H 3/00; A63H 33/04; A63H 3/02

[52] U.S. Cl. ..... 446/72; 446/92; 446/372; 446/901; 5/491; 5/639

[58] Field of Search ..... 446/71, 72, 73, 74, 446/92, 147, 151, 177, 369, 372, 391, 491, 901; 5/433, 442, 485, 491

[56] References Cited

U.S. PATENT DOCUMENTS

| | | | |
|---|---|---|---|
| D. 62,265 | 4/1923 | Riley | 446/369 X |
| D. 269,575 | 7/1983 | Fogarty et al. | D6/203 |
| D. 301,728 | 6/1989 | Garner | D21/167 |
| D. 305,711 | 1/1990 | Wood | D6/601 |
| 1,490,295 | 4/1924 | Stephens | 446/147 X |
| 1,651,738 | 12/1927 | Stein et al. | 446/327 |
| 1,768,334 | 6/1930 | Stein et al. | 446/297 |
| 2,628,452 | 2/1953 | Gladstein | 446/28 |
| 3,475,852 | 11/1969 | Brosk | 446/369 X |
| 3,789,546 | 2/1974 | Morrison | 5/485 X |
| 4,288,222 | 9/1981 | Kling | 446/801 X |
| 4,590,633 | 5/1986 | Pickens | 5/485 X |
| 4,853,994 | 8/1989 | Ekstein | 446/73 X |
| 4,874,340 | 10/1989 | Smallwood | 446/72 X |
| 4,889,512 | 12/1989 | Burnett et al. | 5/490 X |
| 4,950,194 | 8/1990 | Gullace | 446/369 X |
| 4,959,879 | 10/1990 | Marxhausen | 5/490 X |
| 4,979,921 | 12/1990 | Cardillo | 446/26 |

FOREIGN PATENT DOCUMENTS

| | | | |
|---|---|---|---|
| 2698 | of 1903 | United Kingdom | 5/490 |
| 1047831 | 11/1966 | United Kingdom | 446/177 |

OTHER PUBLICATIONS

Needlework Patterns, McCalls, Jan. 1960, p. 165.

*Primary Examiner*—Mickey Yu
*Assistant Examiner*—D. Neal Muir
*Attorney, Agent, or Firm*—Harold Gell

[57] ABSTRACT

A security object system including a pillowcase with an opening across the back for inserting or removing a pillow and a stylized mother and father rendered on the front of the case. Removable pouches are attached at either end of the pillowcase and are dimensioned to receive one each of two dolls. The dolls are stylized to represent a son and daughter bearing family resemblances to the stylized mother and father depicted on the face of the pillowcase. Each doll incorporates a suction cup on its back so that it may be fastened to a smooth surface. The clothing for the dolls is removable.

17 Claims, 5 Drawing Sheets

FIG. 4
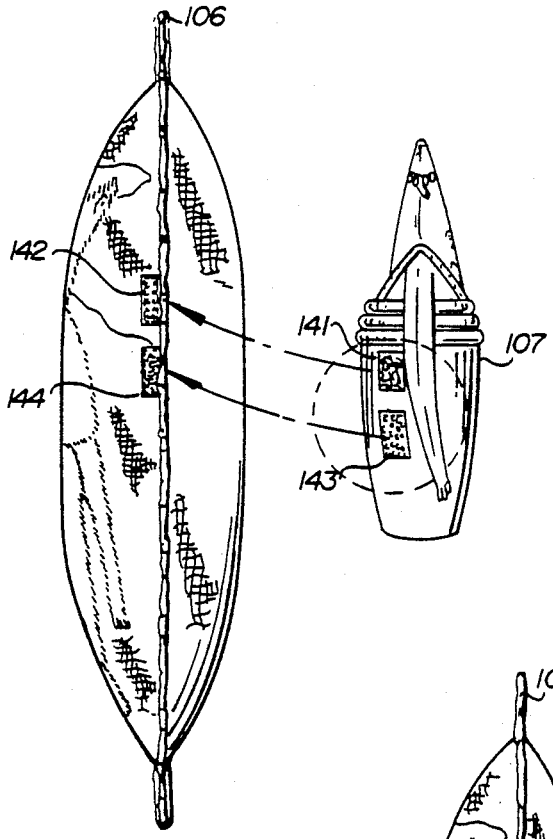
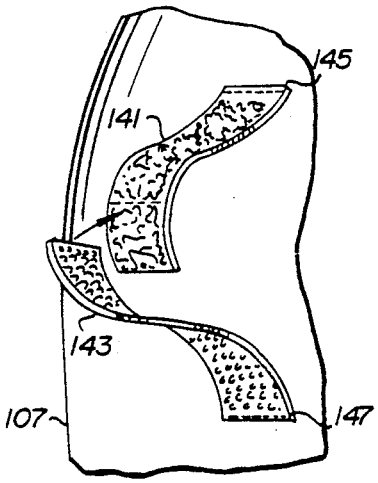
FIG. 4a
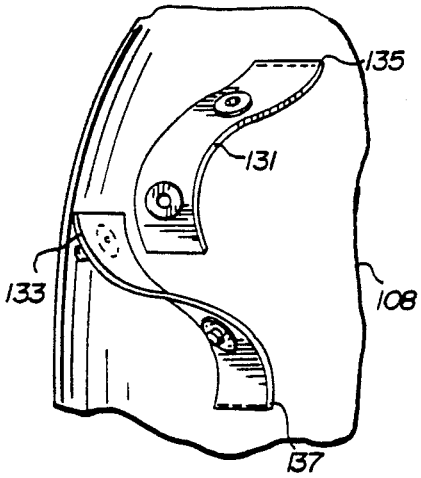
FIG. 3a
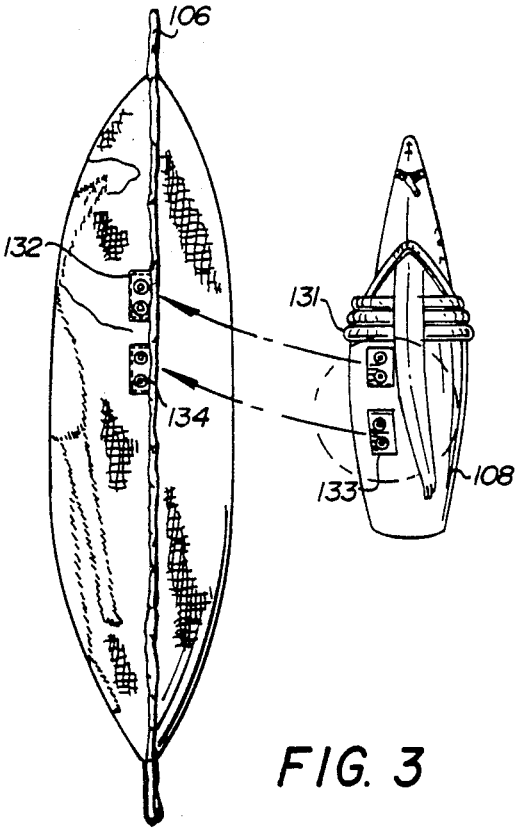
FIG. 3

SECURITY OBJECT SYSTEM

FIELD OF THE INVENTION

A security object system comprised of a combined pillowcase and doll carrier wherein the pillowcase includes a family unit depiction and removable pockets provide carrying means for removable dolls related to the family unit.

BACKGROUND OF THE INVENTION

It is a generally accepted fact that young children adopt an item of bedding, a stuffed doll or animal or some other soft object as a symbol of the most secure place in their life, their crib. From that symbol they derive a sense of security that they can carry with them to more threatening environments. The most widely used symbol is generally the blanket or a piece cut from the blanket that the child used in earliest infancy. No commercial attempt has been made to meet this universal need until the advent of the present invention of a pillowcase and dolls graphically interconnected to fulfill a child's need for security. Numerous combinations of dolls and pillows have been created but not for the specific purpose of creating a security object system.

For instance, the U.S. Pat. No. Des. 305,711 on "Pocket With Pillow And Doll" issued to S. Wood on Jan. 30, 1990 illustrates a pillow incorporating a pocket containing a portion of a doll protruding therefrom but there is no graphic familial relationship between the doll and pillow.

A. Fogarty et al, U.S. Pat. No. Des. 269,575 on "Combined Pillow And Finger Puppets" issued Jul. 5, 1983 illustrates a pillow with a plurality of pockets, each of which contains a puppet but this also fails to relate the combination to a secure family setting.

M. Garner, U.S. Pat. No. Des. 301,728 on "Combined Dolls And Carrier" issued Jun. 20, 1989 is an exemplary doll carrier of interest but as in the case of all known doll carriers, there is no familial tie to an object found in a crib.

U.S. Pat. Nos. 4,889,512; 3,789,546; 1,768,334; and 1,651,738 are typical examples of pillows including pockets which contain dolls but they are completely devoid of any suggestion of a familial relationship between the doll and pillow.

The deficiencies of the prior art are solved by the present invention through a system which address the following objectives.

OBJECTIVES OF THE INVENTION

A primary objective of the present invention is to provide a security reassurance system for a young child including a pillow bearing a design representing home and family authority figures and removable pockets containing removable doll security figures.

Another objective of the present invention is to provide a doll carrier/pillowcase combination including removable pockets and removable dolls within said pockets.

A further objective of the invention is to provide a security reassurance system including removable components that may be used to reduce the physical size of the security object.

Another objective of the present invention is to provide a doll carrier/pillowcase combination including removable pockets and removable dolls within said pockets wherein a familial tie between the dolls and pillowcase is created by graphics on the elements of the invention.

A still further objective of the invention is to provide a security object comprised of a plurality of components which may be removed as adjuncts to a process of weaning a child from said security object.

Another objective of the present invention is to provide a doll carrier/pillowcase combination including removable pockets and removable dolls within said pockets wherein the dolls represent children and the pillowcase is graphically treated to represent parents and home.

Another objective of the present invention is to provide a doll carrier/pillowcase combination including removable pockets and removable dolls within said pockets wherein the dolls include means for securing them to a smooth surface.

Another objective of the present invention is to provide a doll carrier/pillowcase combination including removable pockets and removable dolls within said pockets wherein the pockets include means for securing them to the clothing of a child.

The preceding and other objectives of the present invention will become apparent in light of the specification and drawing depicting the invention which follow.

SUMMARY OF THE INVENTION

A security object system comprised of a pillowcase provided with renderings of a home and mother and father figures is provided with detachable pockets adapted to hold removable male and female dolls bearing a familial resemblance to the figures rendered on the pillowcase and designed to represent children of the depicted family. The system is used by providing an infant with the pillow and doll combination as a security object. As the child matures, the pockets and dolls may be removed to accompany the child on trips or away from the secure environment. Other weaning techniques may be used depending upon the needs of the child and circumstances by selecting and omitting various components of the system.

DESCRIPTION OF THE DRAWINGS

FIGS. 3 and 3A illustrate a snap fastening means for the doll pockets of the present invention.

FIGS. 4 and 4A illustrate a Velcro type attachment means for the doll pockets.

DESCRIPTION OF THE INVENTION

Figure 1:
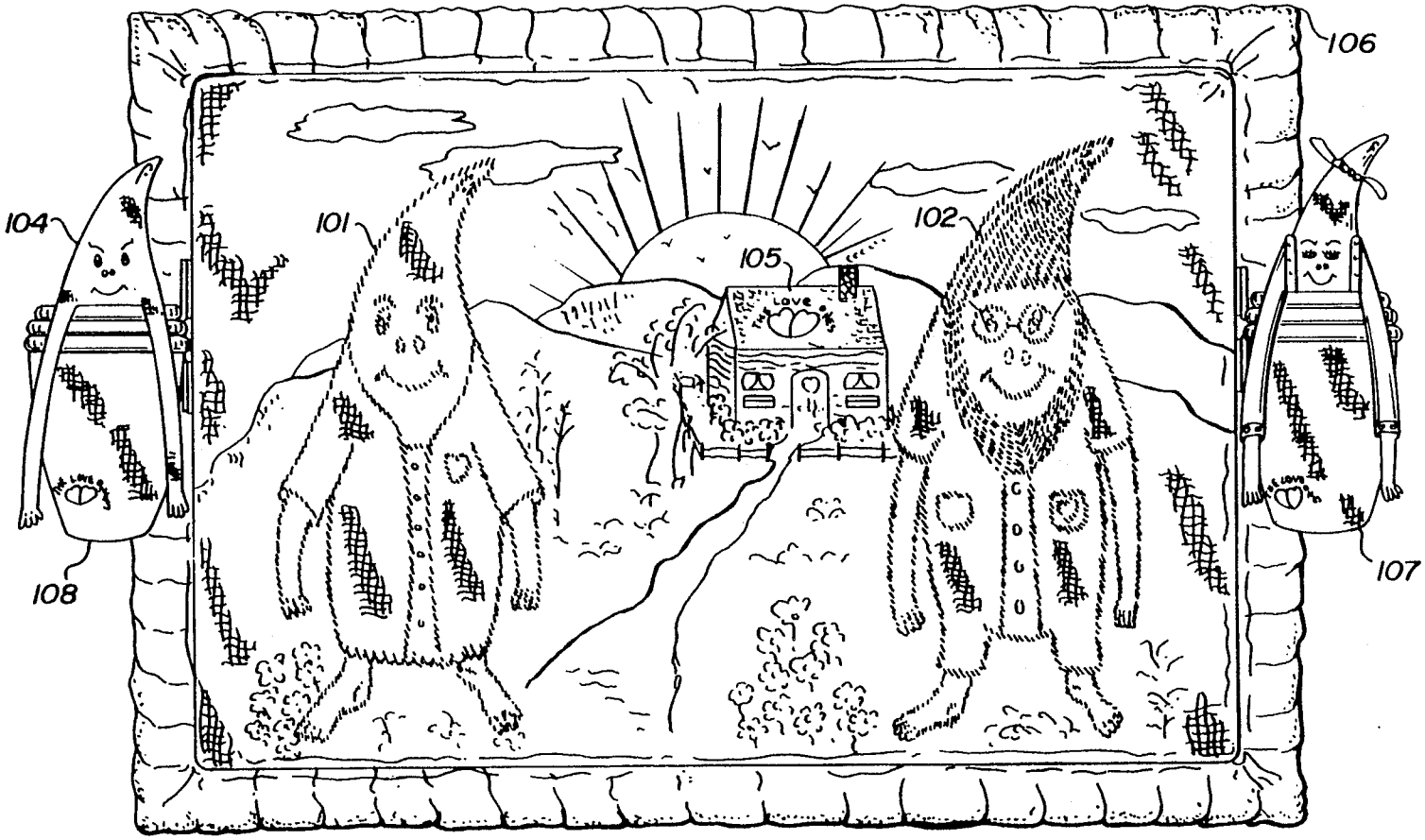
FIG. 1 is a front view of the complete security object system of the present invention.

FIG. 1 is a front view of a preferred embodiment of the security object system. It is comprised of a mother symbol 101 and father symbol 102 depicted on a scene including a cottage or home 105 in a pastoral setting rendered on a pillowcase 106. A son and daughter in the shape of dolls 104 and 103 respectively bear a familial resemblance to the parent FIGS. 101 and 102 on the pillowcase. The dolls are supported on opposite ends of the pillowcase by pockets 107 and 108 which are removably attached to the pillowcase by a reusable fastening means.

As can be seen in FIG. 1, all members of the family bear a striking similarity of body and head shape as well as expression to instill in an observing child the concept of the continuity of a family group and a peaceful home setting.

The pillowcase is designed to be removable so that it may be washed and used with a variety of pillows. An opening 120, in the back of the pillowcase illustrated in FIG. 2 demonstrates the means whereby a pillow may be inserted or removed. This opening may be a simple overlapping cloth flap, a Velcro closure, a zipper or any convenient means to secure a pillow within the case.

Figure 2:
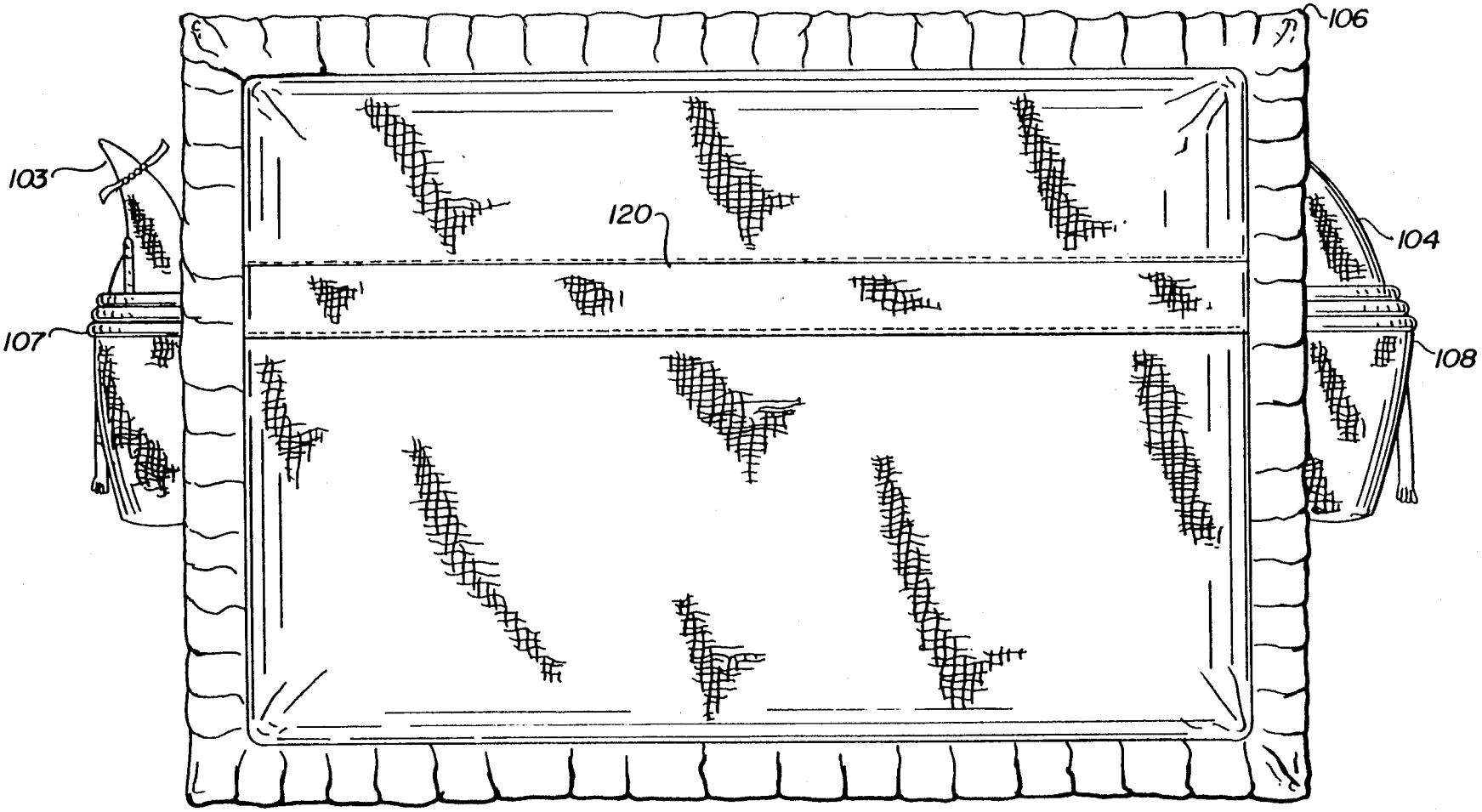
FIG. 2 is a rear view of the security object system illustrating the pillow access opening.

The pockets, 107 and 108 of FIGS. 1 and 2 are illustrated in more detail in FIGS. 3 through 4 A. The pockets are interchangeable in that they are symmetrical devices which include a fastening means along one edge. For instance, in FIG. 3 the pocket 108 is provided with a pair of snap fastening tabs 131 and 133. These tabs mate with corresponding snap coupling means 132 and 134 which are secured to the edge of the pillowcase 106. FIG. 3A is a detailed view of the snap fasteners 131 and 133. Note that they are secured to the pocket 108 only at edges 135 and 137. Note also that tab 131 is comprised of female snap fastening means and 133 male snap fastening means and the tabs are long enough so that a fastener on 133 may be secured to a coupling part on 131. This allows the formation of a belt loop or securing loop whereby the pocket may be attached to an article of clothing or a structure such as a car seat, chair, playpen or other device.

FIGS. 4 and 4A illustrate an alternate pocket securing means. In FIG. 4, pocket 107 is provided with two Velcro couples, 141 and 143. Velcro couple 141 is a pile member and 143 is the hook member of the Velcro coupling as can be seen more clearly in FIG. 4A. The relative positioning of the two elements of the Velcro couple are immaterial in that 141 may just as easily be the Velcro hook member just so long as 143 is the pile member. In the embodiment illustrated in FIG. 4, the pillow is provided with a Velcro style hook member 142 which cooperates with the pile of member 141 and a pile member 144 which cooperates with the hook member 143 on the cup.

The detailed structure of the Velcro couple illustrated in FIG. 4A more clearly shows that the hook and pile tabs are secured at one only, 147 and 145 respectively and the lengths of the tabs are such that they may interconnect to form a securing loop as described in FIGS. 3 and 3A.

Figure 5:
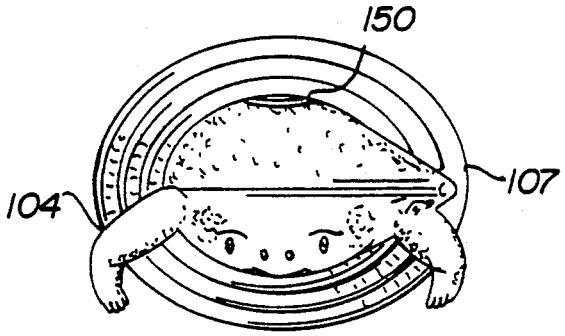
FIG. 5 is a top view of a doll within a pocket.
Figure 6:
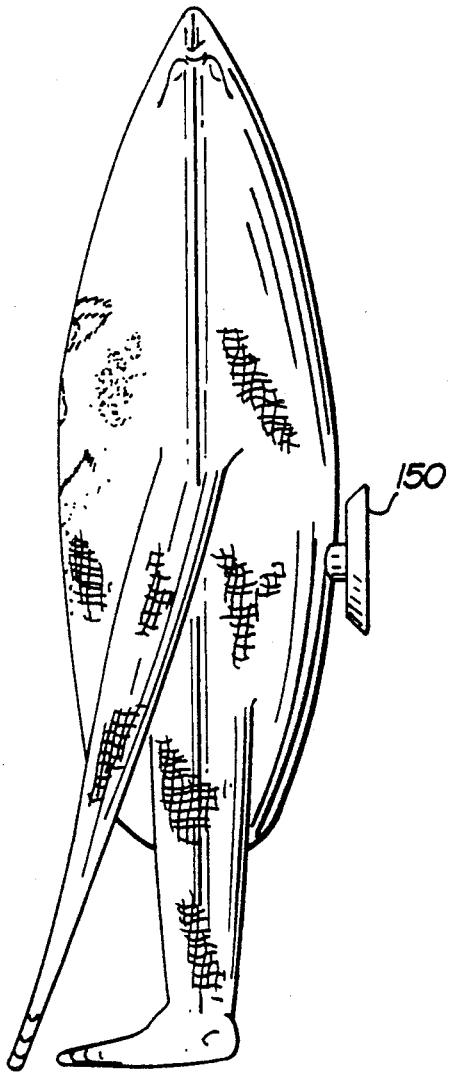
FIG. 6 is a side view of a doll with its clothing removed illustrating the suction cup attachment means.

FIG. 5 is a top view of a typical pocket 107 illustrating one of the dolls, 104 nestled in the pocket. A suction cup 150 is provided in the back of the doll to allow the doll to be secured to a smooth surface when not contained with the pocket. The suction cup may be seen more clearly in FIG. 6 which illustrates a typical doll without its removable clothing.

Figure 7:
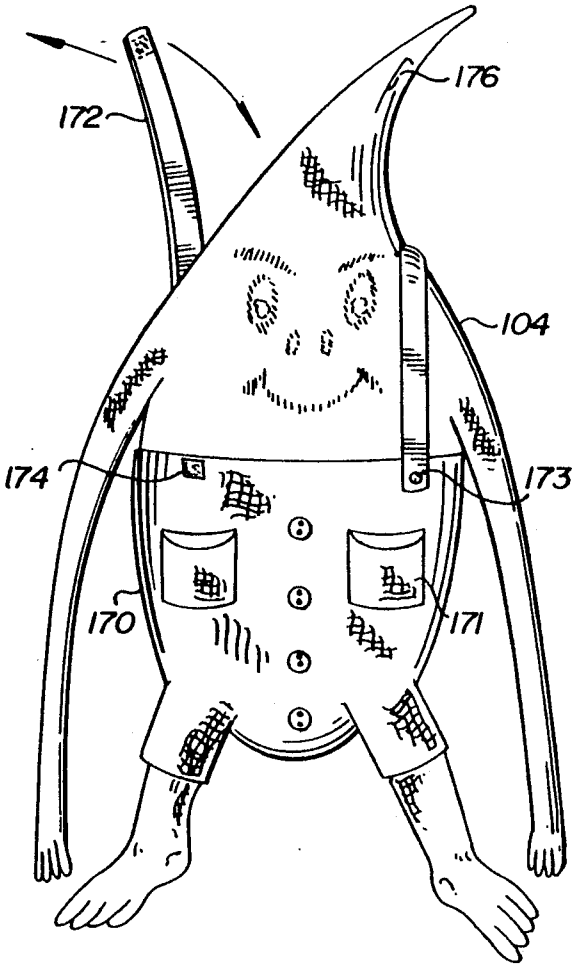
FIG. 7 is a front view of a completely dressed male doll.

FIG. 7 is a detailed view of the male doll 104 illustrating the removable clothing 170. Note that the clothing for the male doll is comprised of a suspender supported pair of trousers including pockets 171. The suspenders, 172 may be secured by a button 173 or Velcro style fastener 174.

Figure 8:
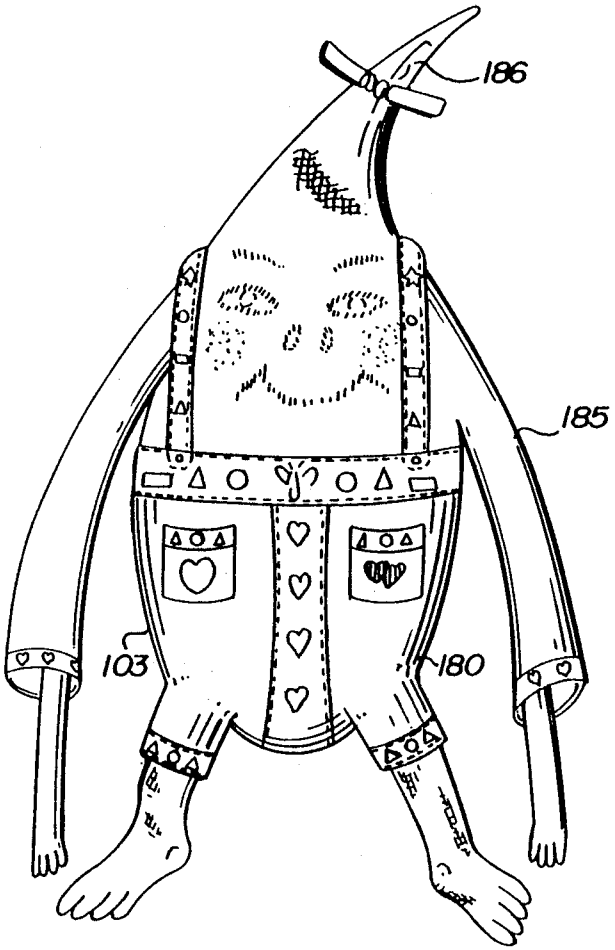
FIG. 8 is a front view of a completely dressed female doll.

The girl doll 103 illustrated in FIG. 8 is provided with a pair of removable trousers 180 similar to the trousers of the boy doll 170 in that they are secured by suspender means and provided with pockets. The garment for the girl doll is more fashionable and provided with decorations. Furthermore, a blouse 185 is provided for the girl doll. Both the trousers 180 and blouse 185 are removable and other articles of clothing may be provided if desired.

Both dolls include an ear hole 176 and 186 that may be in the form of a button hole to allow the doll to be attached to an article of clothing or hung over a convenient peg or hook means. Note that this ear hole (button hole) is evident in all family members illustrated in FIG. 1.

Ideally the system is used by introducing an infant to the complete pillow and doll combination as illustrated in FIG. 1. In this way, a child's earliest experience relates to the pillow and doll combination and a security bond will develop. As the child begins travelling, the pillow and dolls may accompany the child to provide a security link between the crib and whatever travelling arrangements are being used. As the child matures, the components may be separated and one or more of the dolls may be carried by the child while the pillow remains in the child's bed with the dolls returned to the pillow when the child retires for the evening or for a nap during the day. Eventually, the child may be weaned from dependence on the security object by reducing the carried object to a single doll and eventually eliminating the total system.

While preferred embodiments of this invention have been illustrated and described, variations and modifications may be apparent to those skilled in the art. Therefor, I do not wish to be limited thereto and ask that the scope and breadth of this invention be determined from the claims which follow rather than the above description.

What I claim is:

1. A security object system, comprising:

a doll configured to have the appearance of a stylized humanoid child;

a pillow including a design comprising a stylized home and two humanoid figures stylized to represent parents of said doll;

means for carrying said doll fabricated in the shape of a pocket including front and back panels closed along the bottom and both sides;

a multi-element fastener means for removably connecting said pocket to said pillow including a first fastening element secured to said pillow and a mating fastening element secured to said pocket;

said doll further comprising a button hole means for attachment to an apparel button, said button hole designed as an ear hole in the top section of said doll's head; and said doll normally removably carried partially within said pocket.

2. A security object system as defined in claim 1, comprising:

a second pocket;

second fastener means for movably connecting said second pocket to said pillowcase; and a second doll removably carried partially within said second pocket.

3. A security object system as defined in claim 2 wherein said second doll has a familial resemblance to said doll.

4. A security object system as defined in claim 3 wherein said doll and said second doll are designed to represent offsprings of opposite sex of said stylized figures in said design representing parents.

5. A security object system as defined in claim 4 wherein said doll and said second doll are clothed with removable clothing styled to indicate offsprings of opposite sex.

6. A security object system as defined in claim 5 wherein said doll, said second doll and said stylized figures in said design representing parents have tear drop shaped heads including a top section terminated by an apex curved to one side.

7. A security object system, comprising:

first and second pockets;

first and second dolls having a familial resemblance and removably carried partially within said pockets;

a pillowcase including a design including figures stylized to represent both parents of the entity represented by said dolls and having a familial similarity to said dolls;

first and second fastener means for removably connecting said pockets to said pillowcase;

a stylized home incorporated in said design;

said first and second dolls designed to represent offsprings of opposite sex of said stylized figures in said design;

said first and second dolls and said stylized figures in said design representing parents including tear drop shaped heads comprising a top section including an apex curved to one side and said first and said second dolls including a button hole formed in said top section of their heads and said stylized figures in said design representing parents including button hole replicas formed in said top sections of their heads.

8. A security object system as defined in claim 7 wherein said fastener and said second fastener are comprised of hook and pile fastener means.

9. A security object system as defined in claim 7 wherein said fastener and said second fastener are comprised of snap fastener means.

10. A security object system as defined in claim 7 wherein said fastener and said second fastener each are comprised of a pair or strap members secured at one end to said pocket and second pocket respectively, said strap members including coupling elements for coupling with cooperating elements secured to said pillow and alternately to the other one of said strap member pair.

11. A security object system, comprising:

a pillowcase;

first and second pockets;

fastener means for removably connecting said pockets to said pillowcase, said fastener means comprised of a pair of strap members for each of said pockets, each of said strap members secured at one end to said pocket, said strap members including coupling elements for coupling with cooperating elements secured to said pillow and alternately to the other one of said strap member pair, first and second dolls stylized to represent children of opposite sex, each removably carried partially within separate ones of said pockets, and a design on said pillowcase including figures stylized with a familial resemblance to represent both parents of the entities represented by said dolls.

12. A security object system as defined in claim 11 wherein said design includes a stylized home.

13. A security object system as defined in claim 12 wherein said dolls and said stylized figures in said design have tear drop shaped heads including a top section terminated by an apex curved to one side.

14. A security object system as defined in claim 13 wherein said dolls have a button hole formed in said top section of their heads and said stylized figures in said design have button hole replicas formed in the top section of their heads, comprising a suction cup secured to the back of each doll.

15. A doll carrier, comprising:

a pillowcase;

first and second pockets;

fastener means for removably connecting said pockets to said pillowcase, said fastener means comprised of a pair of strap members for each of said pockets, each of said strap members securd at one end to said pocket, said strap members secured coupling elements for coupling with cooperating elements secured to said pillow and alternately to the other one of said strap member pair, first and second dolls stylized to represent children of opposite sex, each removably carried partially within separate ones of said pockets, and a design on said pillowcase including figures stylized with a familial resemblance to represent both parents of the entities represented by said dolls.

16. A doll carrier as defined in claim 15 wherein said dolls and said stylized figures in said design have tear drop shaped heads including a top section terminated by an apex curved to one side.

17. A doll carrier as defined in claim 13 wherein said dolls have a button hole formed in said top section of their heads and said stylized figures in said design have button hole replicas formed in the top section of their heads.

* * * * *

UNITED STATES PATENT AND TRADEMARK OFFICE

CERTIFICATE OF CORRECTION

PATENT NO. : 5,118,318

DATED : 06/02/92

INVENTOR(S) : Robert Lorizio

It is certified that error appears in the above-indentified patent and that said Letters Patent is hereby corrected as shown below:

Column 2, line 67 after "shape of" please insert --humanoid--.

Signed and Sealed this

Thirteenth Day of July, 1993

*Attest:*

Michael K. Kirk

MICHAEL K. KIRK

*Attesting Officer*

*Acting Commissioner of Patents and Trademarks*